United States Patent [19]

Kassbaum

[11] Patent Number: 4,951,590

[45] Date of Patent: Aug. 28, 1990

[54] UMBRELLA-LIKE APPARATUS FOR CLOSING AN UNWANTED APERTURE IN A SUBSTANTIALLY PANEL-LIKE MEMBER IN AN EMERGENCY

[76] Inventor: Gary W. Kassbaum, 32 Earl Haig Avenue, Toronto, Ontario, Canada, M4C 1E1

[21] Appl. No.: 331,138

[22] Filed: Mar. 31, 1989

[30] Foreign Application Priority Data

Mar. 31, 1988 [GB] United Kingdom ..... 8807719
Sep. 15, 1988 [GB] United Kingdom ..... 8821561

[51] Int. Cl.[5] ..... B63B 43/16
[52] U.S. Cl. ..... 114/227; 135/22
[58] Field of Search ..... 114/227–229; 135/22, 24

[56] References Cited

U.S. PATENT DOCUMENTS 5,845 10/1848 Seely ..... 114/227
2,220,085 11/1940 Dirschel ..... 114/227
4,736,761 4/1988 Warfield ..... 135/24

*Primary Examiner*—Joseph F. Peters, Jr.
*Assistant Examiner*—Jesûs D. Sotelo
*Attorney, Agent, or Firm*—Arne I. Fors

[57] ABSTRACT

Umbrella-like apparatus for closing an unwanted aperture in a substantially panel-like member in an emergency has a longitudinally-extending shaft, a collar mounted on the shaft for sliding movement therealong, and a spring acting between the collar and a fixed abutment on the shaft. A series of arms are each mounted at one end for pivotal movement relative to the shaft, and the collar is moveable from a first position to a second position to cause the arms to move from a first position substantially parallel to the shaft to a second position substantially perpendicular thereto. A flexible covering is secured to the arms and is in a folded condition when the arms are in the first position substantially parallel to the shaft. A manually-operable retainer retains the collar in the first position with the spring in an actuating condition and with the arms in the first position and the flexible covering in the folded condition. The manually-operable retainer is manually releasable to permit the collar to be propelled along the shaft by the spring with resultant movement of the arms from the first position substantially parallel to the shaft to the second position substantially perpendicular thereto with the flexible covering thereby being deployed to an aperture-closing configuration.

10 Claims, 6 Drawing Sheets

UMBRELLA-LIKE APPARATUS FOR CLOSING AN UNWANTED APERTURE IN A SUBSTANTIALLY PANEL-LIKE MEMBER IN AN EMERGENCY

This invention relates to umbrella-like apparatus for closing an unwanted aperture in an emergency.

The unwanted aperture may, for example, be a hole in a boat hull caused by the boat striking an underwater obstruction, or may, for example, be a hole in the wall of a liquid-containing tank caused by a collision between the tank and another object. In the latter case, the tank may, for example, be one being transported by rail or by road, with the unwanted aperture being caused in a rail or road accident.

Various prior proposals have previously been made with respect to the provision of umbrella-like apparatus for closing an unwanted aperture in a panel-like member in an emergency. Such apparatus has umbrella-like arms with a flexible covering normally in a folded condition. In use, the apparatus is pushed partially through the aperture in the panel-like member and the arms are then radially extended on one side of the panel-like member to deploy the flexible covering. The apparatus is then pulled rearwardly until the extended arms and hence also the flexible covering engage one side of the panel-like member to close the aperture. However, a primary disadvantage of known apparatus of this kind is the amount of time required for actuation of the apparatus, namely the movement of the arms and flexible covering from a folded position to the operative position, particularly if liquid is leaking through the aperture.

According to the present invention, this problem is at least substantially overcome by providing apparatus in which the arms and flexible covering are retained in the folded condition by spring means which is manually releasable to cause the spring means to propel the arms and flexible covering to the operative position very quickly.

In accordance with the invention, umbrella-like apparatus includes a longitudinally extending shaft, collar means mounted on the shaft for sliding movement therealong, spring means acting between the collar means and the fixed abutment on the shaft, and a series of arms each mounted at one end for pivotal movement relative to the shaft. The collar means is moveable from a first position to a second position to cause the arms to move from a first position substantially parallel to the shaft to a second position substantially perpendicular thereto. A flexible covering is secured to the arms and is in a folded condition when the arms are in the first position substantially parallel to the shaft. Manually-operable retaining means retain the collar means in the first position and the spring means in an actuating condition and with the arms in the first position with the flexible covering in the folded condition. The manually-operable retaining means are manually releasable to permit the collar means to be propelled along the shaft by the spring means with resultant movement of the arms from the first position substantially parallel to the shaft to the second position substantially perpendicular thereto with the flexible covering thereby being deployed to an aperture-closing configuration.

The arms may each be pivotally mounted at one end adjacent a front end of the shaft and extend rearwardly therefrom in the first position of the arms, the flexible covering lying along the length of the arms and being secured thereto, and the collar means engaging inner surfaces of the arms during movement of the collar means along the shaft under the action of the spring means to cause the arms to move from the first position substantially parallel to the shaft to the second position substantially perpendicular to the shaft with consequent deployment of the flexible covering to the aperture-closing configuration.

The retaining means may comprise a cover member fitted over the arms and the flexible covering and ejectable forwardly therefrom upon manual release of the retaining means. The retaining means may comprise a manually-pullable release cable extending along the shaft from a rear end thereof to a cover member retainer, the cable being pullable to release the cover member and permit its ejection.

Alternatively, the arms may each be pivotally mounted at one end on the collar means and extend forwardly therefrom towards a front end of the shaft in the first position of the arms substantially parallel to the shaft to position opposite ends of the arms adjacent to the front end of the shaft, the flexible covering having a central portion secured to the front end of the shaft and a peripheral portion secured to the front ends of the arms and being in a folded condition when the arms are in the first position. The collar means moves forwardly along the shaft under the action of the spring means to cause the arms to pivot to the radially extended position and thereby deploy the flexible covering to the aperture-closing configuration.

Such umbrella-like apparatus may include a series of bracing struts each pivotally connected at a front end to a forward part of the shaft and at a rear end at a respective arm partway along its length.

The release means may include manually-releasable latches carried by a hub mounted on the shaft and engaging the collar means, with the spring means surrounding the shaft and acting between the hub and the collar means.

The umbrella-like apparatus may be provided with means including conduit means in the shaft for supplying quick setting liquid plastic material to a location behind the flexible covering after its deployment.

The umbrella-like apparatus may also include a backing plate member slidable along the shaft from the rear thereof after deployment of the flexible covering to engage the panel-like member on the opposite side thereof to the arms and the flexible covering, the apparatus also including means engageable with the shaft for securing the backing plate member in a panel-like member engaging position. The means for securing the backing plate member in the panel-like member engaging position may comprise a hub slidable along the shaft behind the backing plate member and carrying means to lock the hub in position on the shaft.

The arms may alternatively be pivotally mounted at rear ends on the shaft at an intermediate position along the length thereof and extend forwardly therefrom towards a front end of the shaft in said first position of the arms substantially parallel to the shaft to position front ends of the arms adjacent to the front end of the shaft, said collar means being slidably mounted on the shaft forwardly of said intermediate position, said spring means acting between the collar means and a fixed abutment on the shaft forwardly of the collar means, the flexible covering having a central portion secured to the front end of the shaft and a peripheral portion secured to the front ends of the arms and being in a folded condition when the arms are in the first position, the apparatus also including bracing struts each pivotally connected at a front end to the collar means and at a rear end to a respective arm partway along its length, said collar means moving rearwardly along the shaft under the action of the spring means to cause the arms to be pivoted by the struts to the radially extended condition and thereby deploy the flexible covering to the aperture closing configuration.

The umbrella-like apparatus may also include an inflatable annular diaphragm slidable along the shaft from the rear thereof after deployment of the flexible covering to engage the panel-like member on the opposite side thereof to the arms and the flexible covering to assist the flexible covering in closing the aperture.

Embodiments of the invention will now be described, by way of example, with reference to the accompanying drawings, of which;

Figure 1:
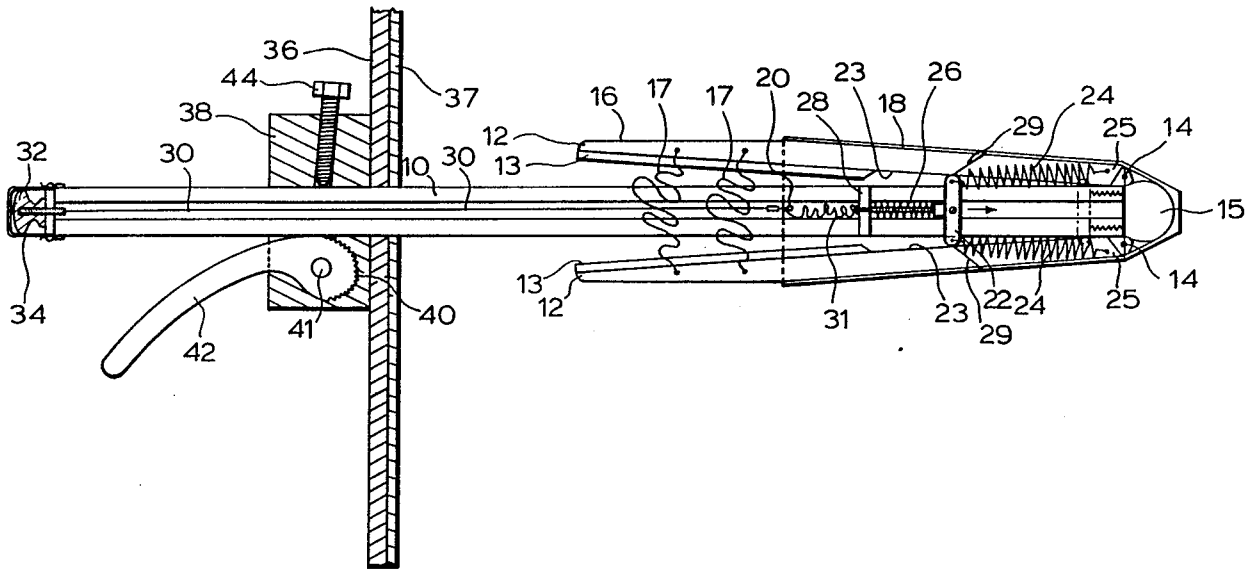
FIG. 1 is a diagrammatic sectional view of umbrella-like apparatus in accordance with one embodiment of the invention.

Referring first to FIG. 1, umbrella-like apparatus has a hollow shaft 10 with a series of arms 12 pivotally mounted at their front ends by pivot pins 14 on an anchor head 15 secured to the front end of the shaft 10. A flexible cover 16 of plastic sheet material surrounds and is secured to the arms 12 in an umbrella-like manner. The inner edges of the rear portions of the arms 12 are provided with rubber cushioning strips 13. FIG. 1 shows the arms 12 in the retracted position in which they extend rearwardly from the front end of the shaft 10 substantially parallel thereto. The flexible covering 16 being in a folded condition. The arms 12 are connected by retaining wires 17 which are slack when the arms 12 are in the retracted position shown. The arms 12 and flexible cover 16 are retained in the retracted position by a retaining cone 18 fitted thereover. The cone 18 is held in place by a releasable retainer 20 carried by the shaft 10.

An annular collar 22 is slidably mounted on the front portion of the shaft 10, with its periphery engaging the inner edges 23 of the forward portions of the arms 12. A series of tension springs 24 extend forwardly from the collar 22 to anchor lugs 25 carried by the anchor head 15, each tension spring 24 being secured at its rear end to he collar 22 and at its front end to a lug 25. A compression spring 26 extends rearwardly within the shaft 10 from the collar 22 to retaining pin 28 secured to the shaft 10.

In the configuration shown, the springs 24 are under tension and the spring 26 is under compression, with both springs 24 and 26 consequently exerting a forward force on the collar 22. However, in this configuration, forward movement of the collar 22 is prevented by the arms 12, movement of which is prevented by the retaining cone 18 which is held in place by the retainer 20 secured to the shaft 10. A loose ring-like member 29 of frusto-conical shape engages the collar 22 at its narrower end and engages the interior of the cone 18 at its wider end. The purpose of ring-like member 29 will become apparent later.

A release cable 30 extends through the shaft 10 from the cone retainer 20 to the rear end of the shaft 10, where the cable 30 is attached to release knob 32. Inadvertent pulling of the release knob 32 is prevented by a safety cap 34 which is a snap fit over the rear end of the shaft 10. A forward extension 31 of the cable 30 extends beyond the cone retainer 20 through the compression spring 26 to the collar 22.

A backing plate 36 with a rubber covering 37 on its front face can be slidably mounted on the shaft 10 from its rear end. A locking hub 38 secured to the rear face of the locking plate 36 is slidable along the shaft 10 therewith. The locking hub 38 can be locked in place on the shaft 10 by a rotatable cam 40 mounted on the locking hub 38 by a pin 41, the cam 40 having a manually-operable lever 42 extending therefrom. Locking hub 38 also carries a set-screw 44 by means of which the locking head 38 can be secured more permanently in position on the shaft 10 by screwing in the set-screw 44 into engagement with the shaft 10.

As indicated previously, FIG. 1 shows the apparatus in the folded or retracted condition. In use, the forward end of portion of the apparatus is pushed through an unwanted aperture in a panel-like member (for example a hole in a boat hull, or a hole in a tank) until the arms 12 are completely through the hole. The safety cap 34 is then removed and the release knob 32 pulled to cause release of the cone retainer 20. The collar 22 is then propelled forwardly under the action of the tension springs 24 and compression spring 26. As the collar 22 moves forwardly, ring like member 29 is moved forwardly to cause forward ejection of the cone 18. At the same time, because of the engagement of the periphery of the collar 22 with the inner edges 23 of the arms 12, the forward movement of the collar 22 causes the arms 12 to pivot outwardly to a position in which they are substantially perpendicular to the shaft 10, with resultant deployment of the flexible cover 16 in an umbrella-like manner and in which position of the arms 12 the retaining wires 17 become taut. At the same time, forward movement of the collar 22 is terminated by engagement with the anchor head 15.

The apparatus is then pulled rearwardly until the radially-extended arms 12, and in particular the rubber strips 13 attached to the rear edges thereof, engage the panel-like member so that the flexible covering 16 closes the hole therein. The looking plate 36 is then slid along the shaft 10 until its rubber pad 37 engages the opposite side of the panel-like member to the side engaged by the arms 12. The locking plate 36 is then initially retained in position by operation of the locking lever 42 to cause cam 40 to engage the shaft 10. A more permanent securement is then obtained by screwing in the set-screw 44 to engage shaft 10. It will be noted that the forward movement of collar 22 also causes release cable 30 to be drawn back into the shaft 10 at its rear end.

Figure 2:
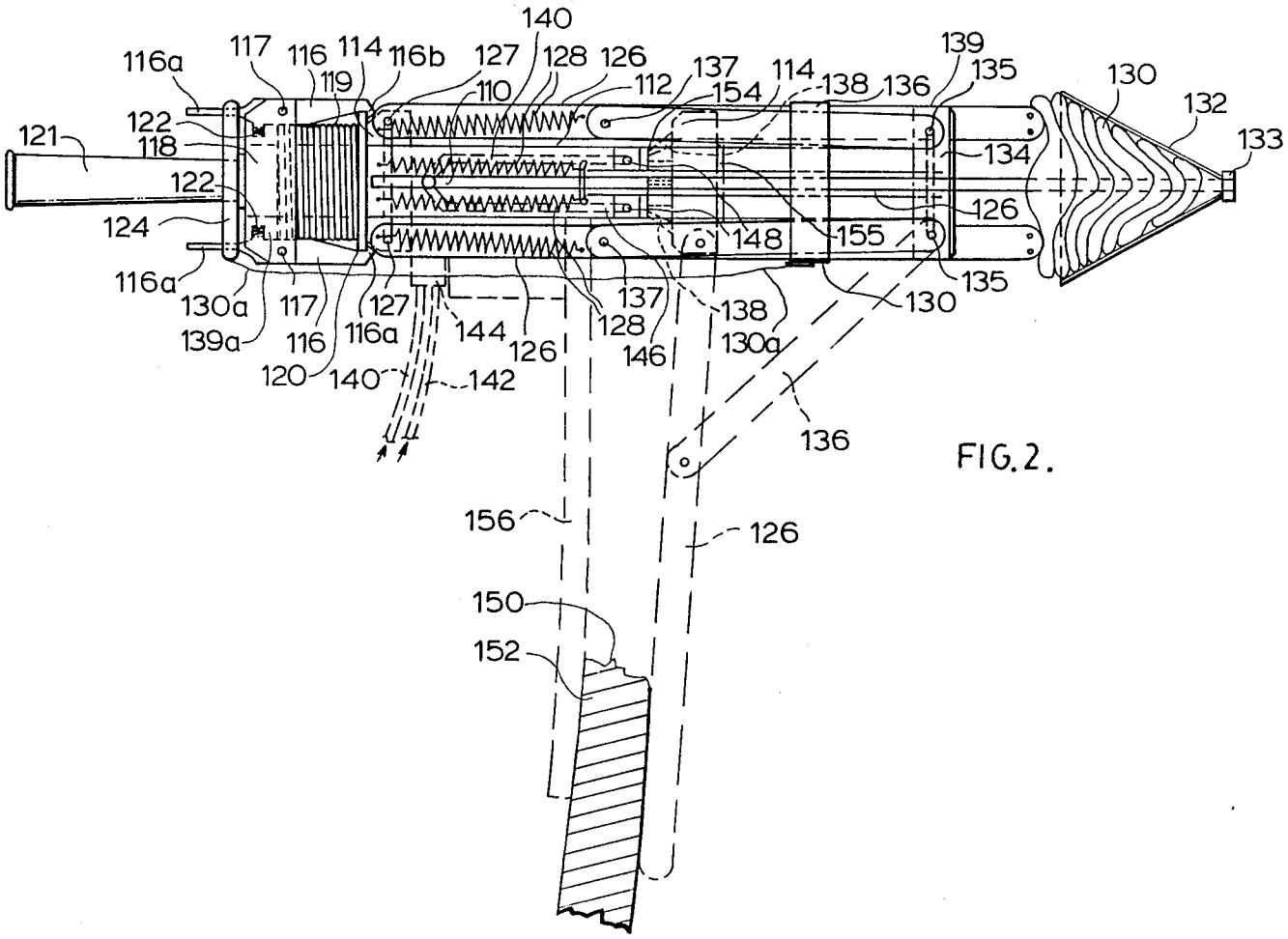
FIG. 2 is a similar view of umbrella-like apparatus in accordance with a second embodiment of the invention, and also showing the deployed configuration in dotted outline.
Figure 2A:
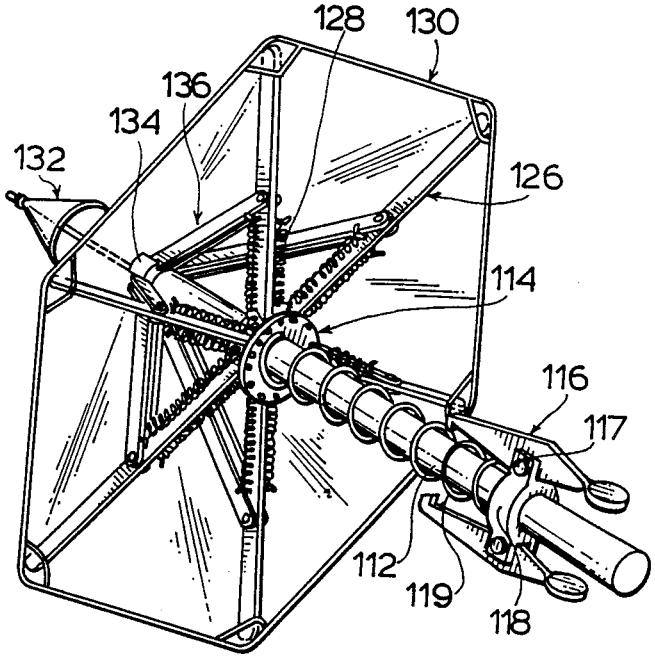
FIG. 2A shows the arrangement of FIG. 2 in fully deployed configuration.

Referring now to FIG. 2, umbrella-like apparatus in accordance with this embodiment includes an inner shaft 110 and an annular outer shaft 112 extending over an initial part of the length of the inner shaft 110. A collar 114 is slidably mounted on the outer shaft 112 near its rear end and is held in position by latches 116 pivotally mounted by pins 117 on hub 118, which in turn is mounted on the rear end of outer shaft 112. The compression spring 119 surrounds outer shaft 112 between hub 118 and collar 114. A retainer ring 120 screwed on to the rear end of the outer shaft 112 prevents rearward movement of the hub 118. A handle 121 extends rearwardly from the rear end of outer shaft 112. The rear end portions of latches 116 can be manually squeezed inwardly towards the handle 121 against the action of springs 122 acting between the latches 116 and the hub 118. Normally, such movement of the latches 116 is prevented by a twist-off annular safety lock 124 which surrounds the rear end portions of the latches 116.

A series of main arms 126 are pivotally connected at their rear ends by pins 127 to collar 114, and tension springs 128 extend between collar 114 and each arm 126. The front ends of arms 126 are secured to the outer periphery of an umbrella-like flexible cover 130, whose central portion extends into and is secured in a cone 132 secured to the front end of inner shaft 110 by nut 133.

An anchor head 134 is secured to the inner shaft 110 rearwardly of the cone 132, and each main arm 126 is provided with a bracing strut 136 pivotally connected at one end by pin 135 to anchor head 134 and at the other end to the main arm 126 by a pin 137 partway along the length of the main arm 126. A series of spring catches 138 are mounted on the rear face of collar 114 for a purpose which will be described later.

In addition to the safety lock 124, further safety is provided by a safety strap 139 which extends around main arms 126 and bracing straps 136. The safety strap 139 comprises a length of material whose opposite ends are releasably secured together in a suitable manner (for example by Velcro) and connected by a release wire **139*a* to the safety lock 124 so that removal of the safety lock 124 also causes release of the safety strap 139**.

Provision is also made for the supply of polyurethane components through tubes 140, 142 to a mixing chamber 144, and from the mixing chamber 144 through conduits 146 in outer shaft 112 to outlets 148 adjacent to the front end of outer shaft 112.

In use, the forward end portion of the apparatus is pushed through an unwanted hole 150 in a panel-like member 152 (which may be part of a boat hull or liquid-containing tank) until the arms 126 are completely through the hole 150. After removal of the twist-off safety lock 124 and the safety strap 139, the rear end portions **116*a* of latches 116 are manually squeezed towards the handle 121 against the action of springs 122 to cause the front end portions 116*b* to be released from the collar 114. The compression spring 119 then propels the collar 114 rapidly forwardly along the outer shaft 112, with the result that the main arms 126 pivot outwardly to a position in which they are substantially perpendicular to the outer shaft 112 as shown in dotted outline in FIG. 2, and with the bracing struts 136 pivoting outwardly from a position parallel to the shaft 110** to the position substantially tangential thereto shown in dotted outline.

The flexible cover 130 is thereby pulled out of the cone 132 and deployed in an umbrella-like manner. The spring catches 138 on the rear of collar 114 snap into an annular groove 154 in outer shaft 112 to retain the collar 114 in the forward position. Forward movement to the collar 114 beyond this position is prevented by an annular stop member 155 secured to the outer shaft 112.

The apparatus is then pulled rearwardly until the radially-deployed arms 126 engage one side of the panel-like member 152, so that the flexible cover 130 substantially prevents passage of liquid form one side of the panel-like member 152 through the hole 150 to the other side. It will be noted that the bracing arms 136 assist in retaining the arms 126 and hence also the flexible cover 130 in the deployed configuration. Also, liquid pressure on the one side of the panel-like member 152 (for example sea or lake water when the panel-like member 152 is part of the boat hull) will act to force the flexible covering 130 against the side of the panel-like member 152, thereby assisting in closing the hole 150.

The retaining ring 120, hub 118 and latches 116 and spring 119 are then removed by sliding rearwardly off the handle 121 and a backing plate 156 and locking hub (not shown) (which may be similar to the backing plate 36 and locking hub 38 of FIG. 1) can then be slid along outer shaft 110 and anchored against the other side of the panel-like member 152.

Polyurethane components can then be pumped through tubes 140, 142 to the mixing chamber 144 and then through conduits 146 and outlets 148 into the space between the flexible cover 130 and the backing plate 156. The mixture can be such that the polyurethane quickly sets to a solid form to still further reduce likelihood of liquid passing through the hole 150.

Figure 3:
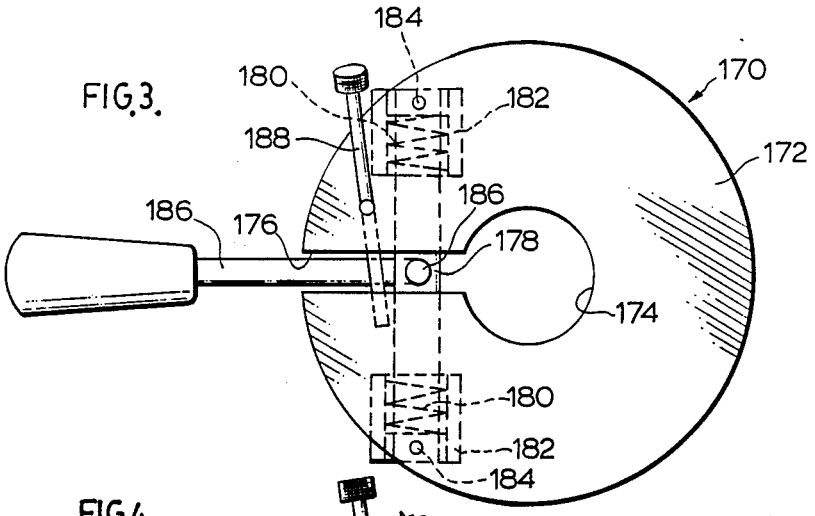
FIG. 3 is a rear view of an alternative locking hub.
Figure 4:
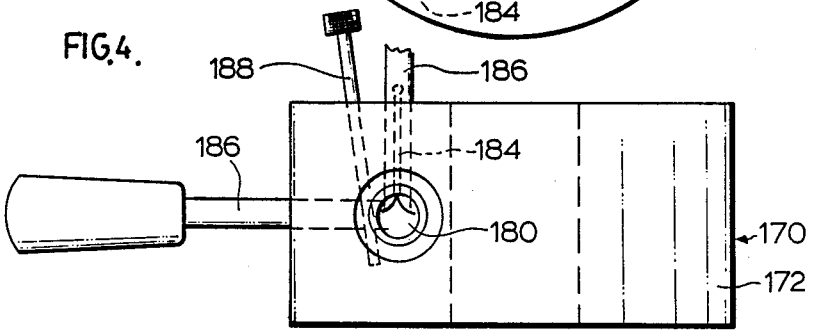
FIG. 4 is a plan view of the locking hub of FIG. 3.

FIGS. 3 and 4 show another form of locking hub 170 which may be used instead of the locking hub 38 or 158 of the previous embodiments. The locking hub 170 comprises a split collar-like body 172 with a central bore 174 which receives the main shaft of the umbrella-like apparatus. The collar-like body 172 has a longitudinally-extending slit 176. A rod 178 with oppositely threaded ends 180 extends within the hub 172 and crosses the slit 176 at the mid-point of the rod 178. The opposite ends of the rod 178 threadingly engage threaded tubular inserts 182 mounted in the body 172 on opposite sides of the slit 176, with rotation of the inserts 182 being prevented by cotter pins 184. A handle 186 connected to the mid-point of the rod 178 projects from the slit 176.

In the position of the handle 186 shown in dotted outline, the width of the slit 176 in the body 172 is greatest. It is in this condition in which the hub 170 is slid onto the shaft of the umbrella-like apparatus. To clamp the hub 170 in place on the shaft, the handle 186 is rotated by 90 degrees to the position shown in full lines. The opposite threading of the rod ends 180 and inserts 182 causes the opposite sides of the slit 176 to be drawn towards each other, thereby clamping the hub 170 on the shaft. The handle 186 can be locked in the clamping position by a locking pin 188 which is inserted through a small bore in the hub body 172 so as to cross slit 176 at a handle locking location.

Figure 5:
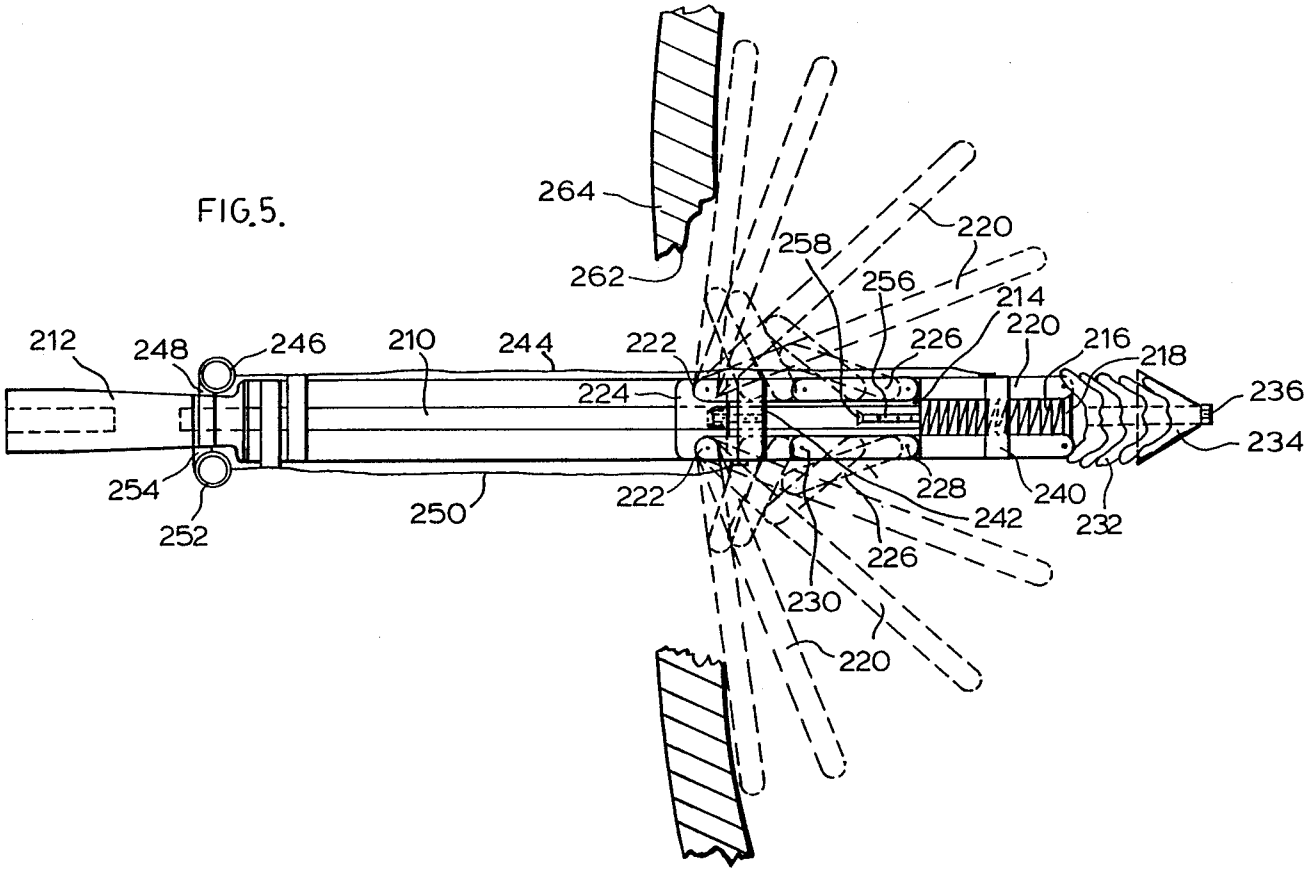
FIG. 5 is a diagrammatic side view of umbrella-like apparatus in accordance with a third embodiment of the invention.

FIG. 5 shows a further embodiment in which the umbrella-like apparatus has a shaft 210 with a handle 212 at its rear end. A collar 214 is slidably mounted on the front end portion of the shaft 210, and a main compression spring 216 surrounds the shaft 210 and acts between collar 214 and an annular retainer ring 218 secured to the shaft 210 near its front end. A series of main arms 220 are pivotly connected at their rear ends by pins 222 to a hub 224 fixedly secured to the shaft 210 approximately mid-way along its length. Each main arm 220 is provided with a bracing strut 226 pivotly connected at one end by pin 228 to the collar 214 and to a respective arm 220 by a pin 230 partway along its length. The front ends of main arms 220 are connected to the outer periphery of an umbrella-like flexible cover 232 whose central portion extends into and is secured within a cone 234 secured to the front end of shaft 210 by nut 236.

In the retracted condition, shown in full lines in FIGS. 5, the arms 220 and struts 226 extend parallel and adjacent to the shaft 210 so that, although spring 216 is compressed and is acting against collar 214, the arms 220 and struts 226 can be held in the retracted position by relatively weak retaining means.

The main arms 220 are held in the retracted condition by a release strap 240 and a safety strap 242 wound around the exterior of the arms 220 and retained in the usual condition by a suitable releaseable fastening such as a Velcro fastening. The release strap 240 is connected by a cord 244 to a first pull ring 246 secured to the handle 212 by releasable tape 248, and the safety strap 242 is connected by a cord 250 to a second pull ring 252 secured to the handle by releaseable tape 254. If desired, shaft extensions (not shown in FIG. 5) may be fitted to the handle 212, in which case the cords 244 and 250 would of course be suitably lengthened.

The collar 214 carries a rearwardly projecting leg 256 with an enlarged free end 258, and the interior of the hub 224 carried a series of inwardly projecting leaf springs (not shown), the purpose of which will be described later.

If use, for example, to close a hole 262 in a tank wall 264, the safety strap 242 is first removed by pulling the safety ring 252. The forward portion of the apparatus is then pushed through the hole 262 until the hub 224 is through the hole. The release ring 246 is then pulled to remove the release strap 240. Since the arms 220 are then free to move radially outwardly, the spring 216 is then able to propel the collar 214 rearwardly along the shaft 210 until it engages the hub 224. During this movement, the arms 220 are pivoted radially outwardly by the struts 226, with consequent deployment of the flexible covering 232, until the arms 220 are substantially perpendicular to the shaft 210.

The hole 262 is thus substantially closed by the flexible covering 232. When the collar 214 engages the hub 224, the enlarged frame end of the leg 256 snaps past the leaf springs to hold the collar 214 in position adjacent the hub 224 and thereby retain the flexible covering in the deployed condition. A suitable backing plate and locking hub similar to those described in previous embodiments can then be attached.

Figure 6:
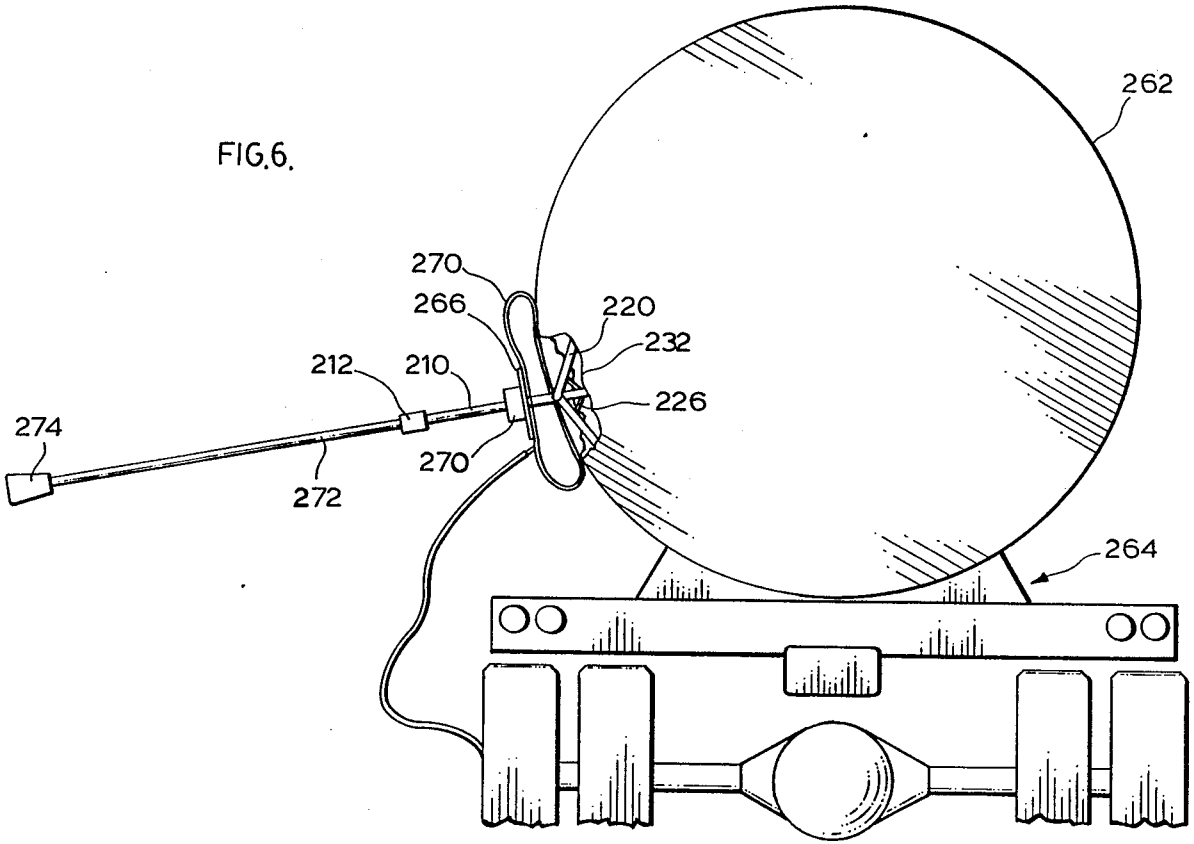
FIG. 6 is a diagrammatic sectional view showing the apparatus of FIG. 5 used to close a hole in a tank, the use of an inflatable diaphragm on the exterior side of the tank wall also being shown.

FIG. 6 shows the apparatus of FIG. 5 used to close a hole in the tank 262 of a tanker truck 264. In this case, before attachment of a backing plate 266 and locking hub 268, an annular inflatable diaphragm (i.e. inflatable ring) 270 is slid along the shaft 210 until it engages the exterior of the tank 262. The diaphragm 270 is then inflated from a suitable air pressure source (not shown), and the backing plate 266 and locking hub 268 then fitted. The inflated diaphragm 270 assists the flexible covering 232 to minimise leakage from the tank 262.

FIG. 6 also shows use of a shaft extension 272 which fits in any suitable manner its the rear of handle 212 and is provided with into own handle 274.

The advantages of the invention will be readily apparent from the foregoing description of preferred embodiments. Other embodiments will also be readily apparent to a person skilled in the art, the scope of the invention being defined in the appended claims.

I claim:

1. An apparatus for the emergency closing of an unwanted aperture in a substantially panel-like member, said apparatus comprising:

(a) a longitudinally extending shaft having a forward end and a rearward end with a fixed abutment over said forward end;

(b) a hub mounted on the forward end of said shaft rearwardly of said abutment;

(c) a collar slidable on said shaft rearwardly of said hub and provided with a plurality of arms around said collar, each pivotally secured thereto at one end and extending toward the forward end of said shaft when in a first fold-down position;

(d) a plurality of support struts around said hub each pivotally secured thereto at one end and extending rearwardly and pivotally secured at their opposite end to a corresponding one of said arms;

(e) a retaining ring secured at the rearward end of said shaft, a spring axially mounted on said shaft and compressed between said retaining ring and said collar when said arms are in the first fold-down position, (f) a flexible liquid impervious covering having a central portion at the front end of said shaft and a peripheral portion extending therefrom and secured to the respective front ends of each of said arms;

(g) securing means for maintaining said arms in the first fold-down position and means for releasing said securing means thereby causing said collar to slide forwardly along said shaft by the expansion of said spring and pivoting said arms upwardly and rearwardly to a second extended-open position.

2. An apparatus as claim in claim 1 wherein each of said arms includes at least one extension spring between the arms and said collar, each said spring being extended under tension when said arms are in the first fold-down position.

3. An apparatus as claimed in claim 2 wherein said means for release includes a pivotally releasable latch between said retaining ring and said collar.

4. An apparatus as claimed in claim 3 wherein said shaft includes an inner shaft and an outer shaft having a fluid passage therebetween.

5. An apparatus for the emergency closing of an unwanted aperture in a substantially panel-like member, said apparatus comprising:

(a) a longitudinally extending shaft having a forward end and a rearward end with a fixed abutment over said forward end;

(b) a hub member mounted on said shaft between the forward end and the rearward end with a plurality of arms around said hub, each pivotally secured thereto at one end and extending toward the forward end of said shaft when in a first fold-down position;

(c) a collar slidable on said shaft between said hub and said abutment with a plurality of support struts around said collar, each pivotally secured thereto at one end and extending rearwardly and pivotally secured at its opposite end to a corresponding one of said arms;

(d) an annular retaining ring at the forward end of said shaft rearward of said abutment;

(e) a spring axially mounted on said shaft, said spring being compressed between said collar and said retaining ring when said arms are in the first fold-down position;

(f) a flexible liquid impervious covering having a central portion at the front end of said shaft and a peripheral portion extending therefrom and secured to the respective front ends of each of said arms;

(g) securing means for maintaining said arms in the first fold-down position and means for releasing said securing means thereby causing said collar to slide rearwardly along said shaft by the expansion of said spring and thereby pivot said arms upwardly and rearwardly to a second extended-open position.

6. Apparatus according to claim 5 also including an inflatable annular diaphragm slidable along the shaft from the rear thereof after deployment of the flexible covering to engage the panel-like member on the opposite side thereof to the arms and the flexible covering to assist the flexible covering in closing the aperture.

7. Apparatus according to claim 5 wherein the retaining means comprises a manually-pullable release cable extending along the shaft from a rear end thereof to a cover member retainer, said cable being pullable to release the cover member and permit its ejection.

8. Apparatus according to claim 7 also including a backing plate member slidable along the shaft from the rear thereof after deployment of the flexible covering to engage the panel-like member on the opposite side thereof to the arms and the flexible covering, and also including means engageable with the shaft for securing the backing plate member in a panel-like member engaging position.

9. Apparatus according to claim 8 wherein the means for securing the backing plate member in the panel-like member engaging position comprises a hub slidable along the shaft behind the backing plate member and carrying means to lock the hub in position on the shaft.

10. Apparatus according to claim 9 including conduit means in said shaft for supplying quick setting liquid plastic material to a location behind the flexible covering after its deployment.

* * * * *